US011684123B2

(12) United States Patent
Bunch et al.

(10) Patent No.: US 11,684,123 B2
(45) Date of Patent: Jun. 27, 2023

(54) FOOTWEAR TRACTION DEVICE AND METHOD OF USING THE SAME

(71) Applicant: Kahtoola, Inc., Flagstaff, AZ (US)

(72) Inventors: Christopher Bunch, Flagstaff, AZ (US); Bradford Lever, Flagstaff, AZ (US)

(73) Assignee: Kahtoola, Inc., Flagstaff, AZ (US)

( * ) Notice: Subject to any disclaimer, the term of this patent is extended or adjusted under 35 U.S.C. 154(b) by 0 days.

(21) Appl. No.: 17/109,057

(22) Filed: Dec. 1, 2020

(65) Prior Publication Data

US 2021/0251344 A1 Aug. 19, 2021

Related U.S. Application Data

(60) Provisional application No. 62/942,204, filed on Dec. 1, 2019.

(51) Int. Cl.
*A43C 15/06* (2006.01)
*A43C 15/16* (2006.01)

(52) U.S. Cl.
CPC ..... *A43C 15/061* (2013.01); *A43C 15/161* (2013.01); *A43C 15/167* (2013.01)

(58) Field of Classification Search
CPC ... A43C 15/061; A43C 15/063; A43C 15/066; A43C 15/068; A43C 15/167; A43C 15/162
See application file for complete search history.

(56) References Cited

U.S. PATENT DOCUMENTS

| | | | | |
|---|---|---|---|---|
| 236,155 | A | 1/1881 | Harris | |
| 1,195,866 | A | 8/1916 | Stephan | |
| 1,760,084 | A | 10/1929 | Pierce | |
| 2,040,186 | A | 10/1931 | Riddell | |
| 2,216,947 | A | 12/1939 | Jones | |
| 2,185,397 | A * | 1/1940 | Birchfield | A43C 15/162 36/67 D |
| 2,509,980 | A * | 5/1950 | McCallum | A43C 15/161 36/62 |
| 2,532,485 | A | 12/1950 | Dowling | |
| 2,668,373 | A | 2/1954 | Russo | |
| 2,758,396 | A * | 8/1956 | Edwardes | A43C 15/161 36/67 D |
| D207,771 | S | 5/1967 | Aufenacker | |
| 3,461,576 | A | 8/1969 | Hubbard | |
| D237,562 | S | 11/1975 | Nobuyuki | |
| 4,246,707 | A | 1/1981 | Pedersen | |
| 4,338,733 | A | 7/1982 | Frechin | |
| 4,353,172 | A | 10/1982 | Bryant | |

(Continued)

FOREIGN PATENT DOCUMENTS

| | | |
|---|---|---|
| CH | 263307 | 8/1949 |
| CH | 296701 | 2/1952 |

(Continued)

OTHER PUBLICATIONS

Extended European Search Report for Application No. 20211061.5 dated Apr. 22, 2021.

*Primary Examiner* — Ted Kavanaugh
(74) *Attorney, Agent, or Firm* — Ballard Spahr LLP

(57) ABSTRACT

The present disclosure is directed toward a device that can be worn over footwear to provide traction, such as on slick or slippery surfaces, in snow, or on ice.

20 Claims, 7 Drawing Sheets

(56) References Cited

U.S. PATENT DOCUMENTS

| | | | | |
|---|---|---|---|---|
| 4,524,966 | A | 6/1985 | Shannon | |
| 5,533,277 | A | 7/1996 | Bell | |
| 5,689,901 | A | 11/1997 | Bell | |
| 5,836,091 | A | 11/1998 | Cook | |
| 5,950,334 | A | 9/1999 | Gerhardt | |
| 5,987,783 | A | 11/1999 | Allen | |
| 6,029,377 | A | 2/2000 | Niikura | |
| 6,154,982 | A | 12/2000 | Bell | |
| 6,301,804 | B1 | 10/2001 | Battaglia | |
| 6,836,977 | B2 | 1/2005 | Larson | |
| 6,915,595 | B2 | 7/2005 | Kastner | |
| 7,165,343 | B2 | 1/2007 | Fukui | |
| RE40,474 | E | 9/2008 | Quellais | |
| 7,428,788 | B2 | 9/2008 | Choi | |
| 8,256,140 | B2 * | 9/2012 | Lagrand | A43C 15/02 36/62 |
| 2002/0029495 | A1 | 3/2002 | Kastner | |
| 2002/0095820 | A1 | 7/2002 | Giovale | |
| 2002/0189133 | A1 | 12/2002 | Parisotto | |
| 2003/0037461 | A1 | 2/2003 | Petzl | |
| 2004/0134102 | A1 | 7/2004 | Kastner | |
| 2004/0194346 | A1 | 10/2004 | Petzl | |
| 2006/0156577 | A1 | 7/2006 | Choi | |
| 2006/0254090 | A1 | 11/2006 | Baxter | |
| 2007/0163148 | A1 | 7/2007 | Laporte | |
| 2007/0227039 | A1 | 10/2007 | Chaney | |
| 2008/0148601 | A1 | 6/2008 | Lefgren | |
| 2008/0184591 | A1 * | 8/2008 | Chang | A43C 15/167 36/7.1 R |
| 2010/0058615 | A1 | 3/2010 | Couder | |
| 2010/0139118 | A1 * | 6/2010 | Park | A43B 5/001 36/62 |
| 2011/0047829 | A1 | 3/2011 | Bell | |
| 2011/0258878 | A1 * | 10/2011 | Jones | A43C 15/066 36/62 |
| 2013/0014409 | A1 | 1/2013 | Chouinard | |
| 2013/0333251 | A1 | 12/2013 | Taniguchi | |
| 2015/0230561 | A1 * | 8/2015 | Bunch | A43C 15/066 36/59 C |
| 2016/0366982 | A1 * | 12/2016 | Chaney | A43C 15/061 |
| 2018/0055149 | A1 * | 3/2018 | Choi | A43C 15/10 |

FOREIGN PATENT DOCUMENTS

| | | | | |
|---|---|---|---|---|
| EP | 2664246 | | 11/2013 | |
| EP | 2893827 | | 7/2015 | |
| GB | 1198419 | | 7/1970 | |
| KR | 20100124492 | A * | 11/2010 | |
| KR | 101351175 | B1 * | 1/2014 | |
| KR | 20140094194 | A * | 7/2014 | |
| WO | WO 2010/027465 | | 9/2009 | |
| WO | WO-2020077448 | A1 * | 4/2020 | A43C 15/061 |

* cited by examiner

FIG. 2D(i) FIG. 2D(ii) FIG. 2D(iii)

FOOTWEAR TRACTION DEVICE AND METHOD OF USING THE SAME

FIELD OF INVENTION

The present disclosure generally concerns footwear or footwear accessory devices, systems, and methods for improving traction.

BACKGROUND

Many attempts have been made to create devices that can be worn over footwear to help provide traction on slick or slippery surfaces, in snow, or on ice. Such footwear traction devices are bulky underneath the foot, provide limited traction, are uncomfortable during use, do not stay in place on the footwear, are heavy; and/or provide insufficient durability. In addition, such footwear traction devices work well on only a single specific surface type, such as either pavement or trail.

SUMMARY OF THE INVENTION

One aspect of the present disclosure is directed toward a device that can be worn over footwear to provide traction on a variety of different terrain, from roads and sidewalks to trails, whether snowy, icy, steep, or uneven. Described embodiments comprise polymeric traction bodies that are stepped, sloping lugs having hard tipped spikes which make the described embodiments useful on diverse terrain, e.g., sidewalks as well as trails, whether or not such terrain is steep and/or uneven and whether or not snowy and/or icy. The polymeric traction bodies combined with the openwork base thereunder have a depth (also referred to as "effective height") suitable for trails and uneven terrain and a material hardness level that makes them suitable and comfortable on smoother surfaces, such as paved surfaces. Moreover, the material hardness level makes for a more comfortable user experience overall.

Described embodiments include a footwear traction device configured to be disposed about footwear comprising an openwork traction base defining a first opening and a second opening, the first opening defined by a first polygonal form having at least four sides with each side having 1 to 4 traction bodies coupled thereto and relatively positioned such that the first opening is predominantly below the forefoot during use; the second opening defined by a second polygonal form having at least three sides and relatively positioned such that the second opening is predominantly below the midfoot and/or hindfoot during use, the openwork traction base comprises at least three traction bodies relatively positioned such that the at least one of the at least three traction bodies are disposed predominantly below the hindfoot during use.

DRAWINGS

FIG. 2D(i) to 2D(iii) are schematic illustrations of alternative configuration of the openwork traction base.

Figure 3:
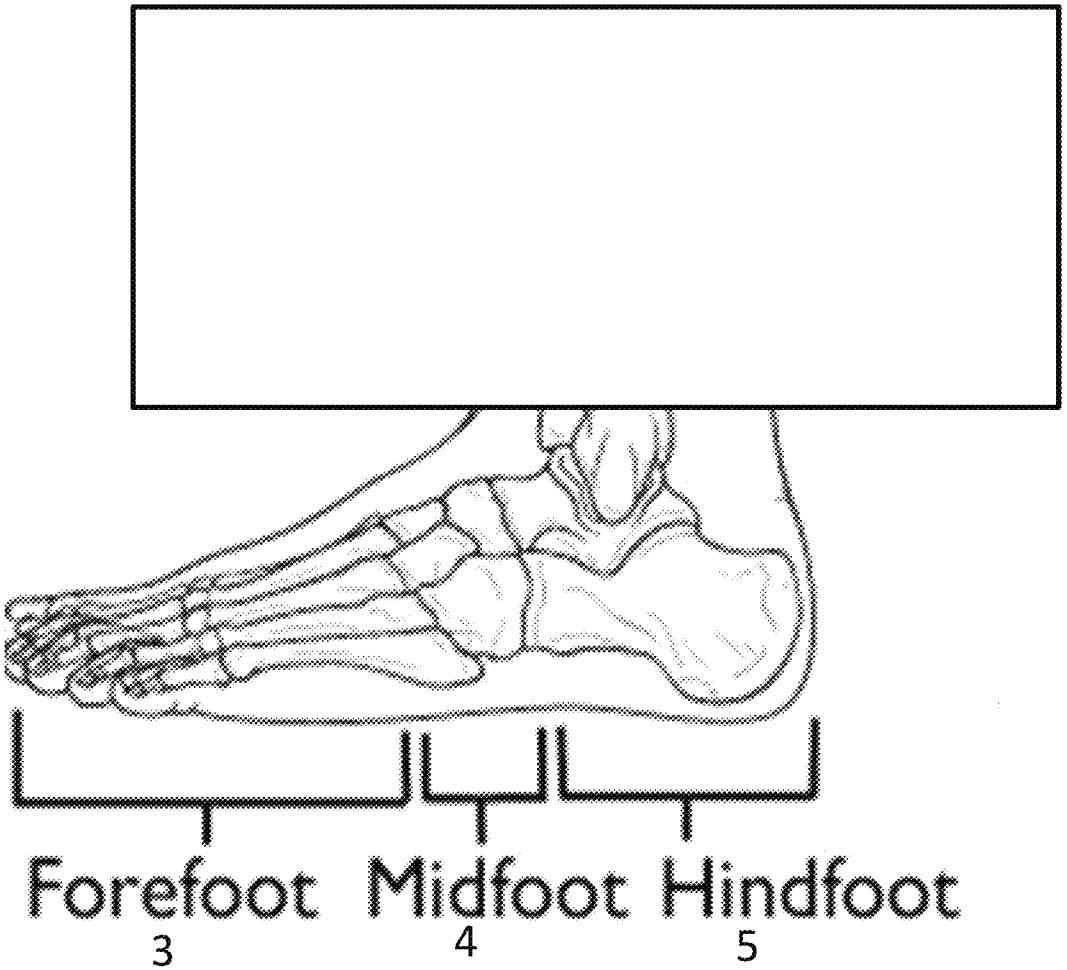

FIG. 3 depicts a human foot to illustrate the forefoot, midfoot, and hindfoot of a user and correspondingly, the forefoot, midfoot, and hindfoot of footwear or footwear traction device.

Figure 4:
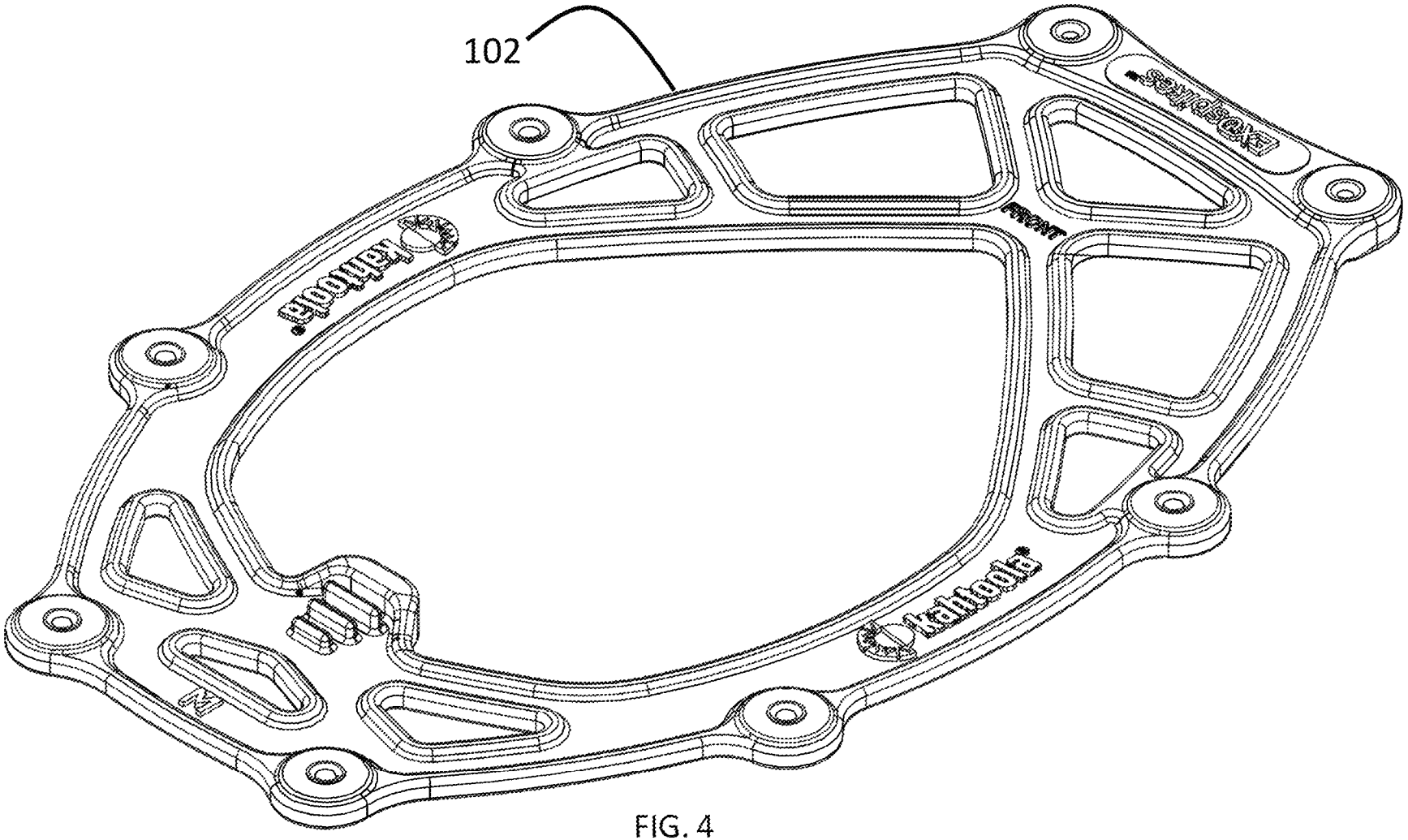

FIG. 4 is a perspective view of an elastic band.

Figure 5:
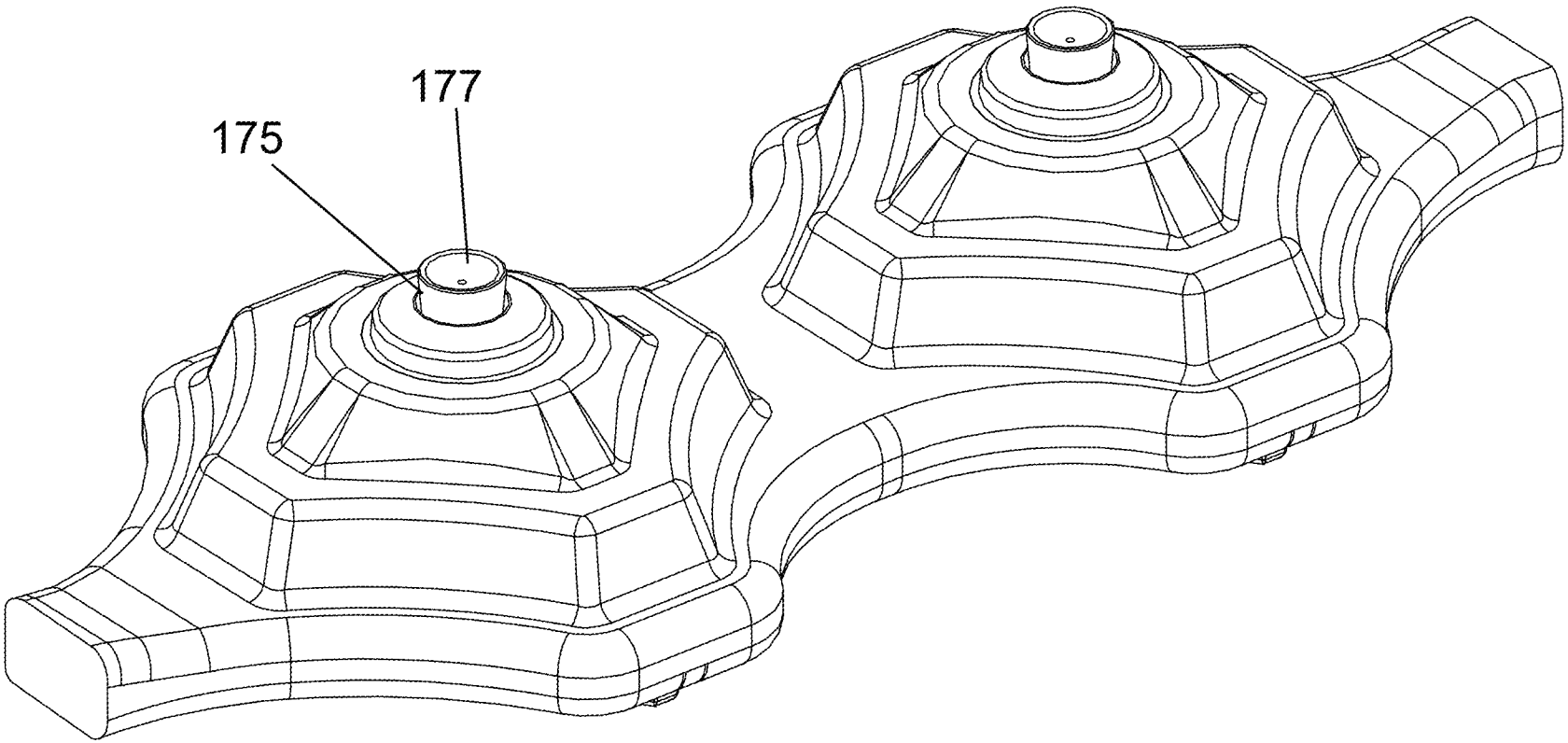

FIG. 5 is a perspective view of two traction bodies with a spike having a distal end that is concave or sunken.

DETAILED DESCRIPTION

Figure 1B:
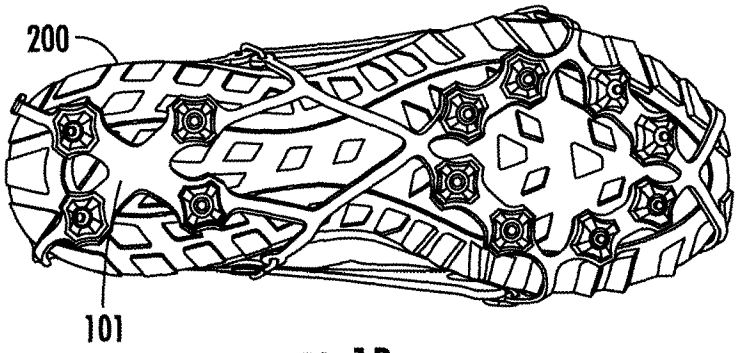
FIGS. 1A to 1C are images of a footwear traction embodiment bound around a footwear in the manner intended for use.
Figure 1C:
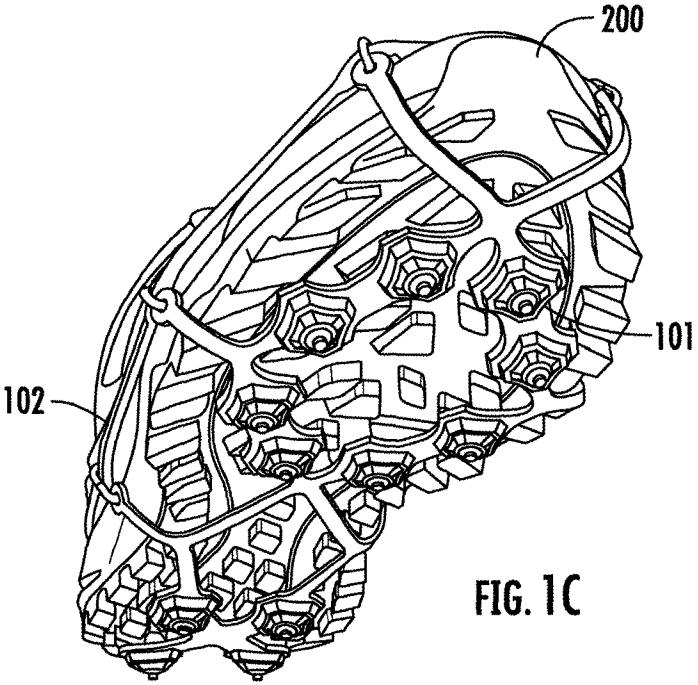
Figure 1A:
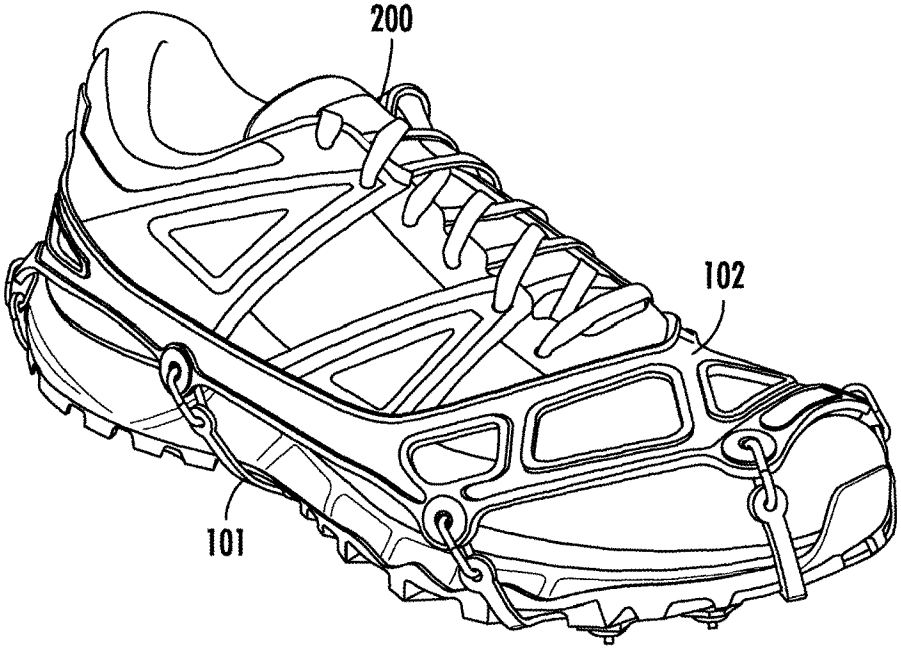

FIG. 1 depicts an embodiment of a footwear traction device 100 in accordance with the present invention. As depicted, the device 100 is configured to be worn over footwear. In FIG. 1, the device 100 is depicted on an item of footwear 200 in the manner intended for use. As shown, a footwear binding member 102 is disposed about a footwear upper 202 and an openwork traction base 101 is disposed on the underside 204 of the footwear 200.

Figure 2A:
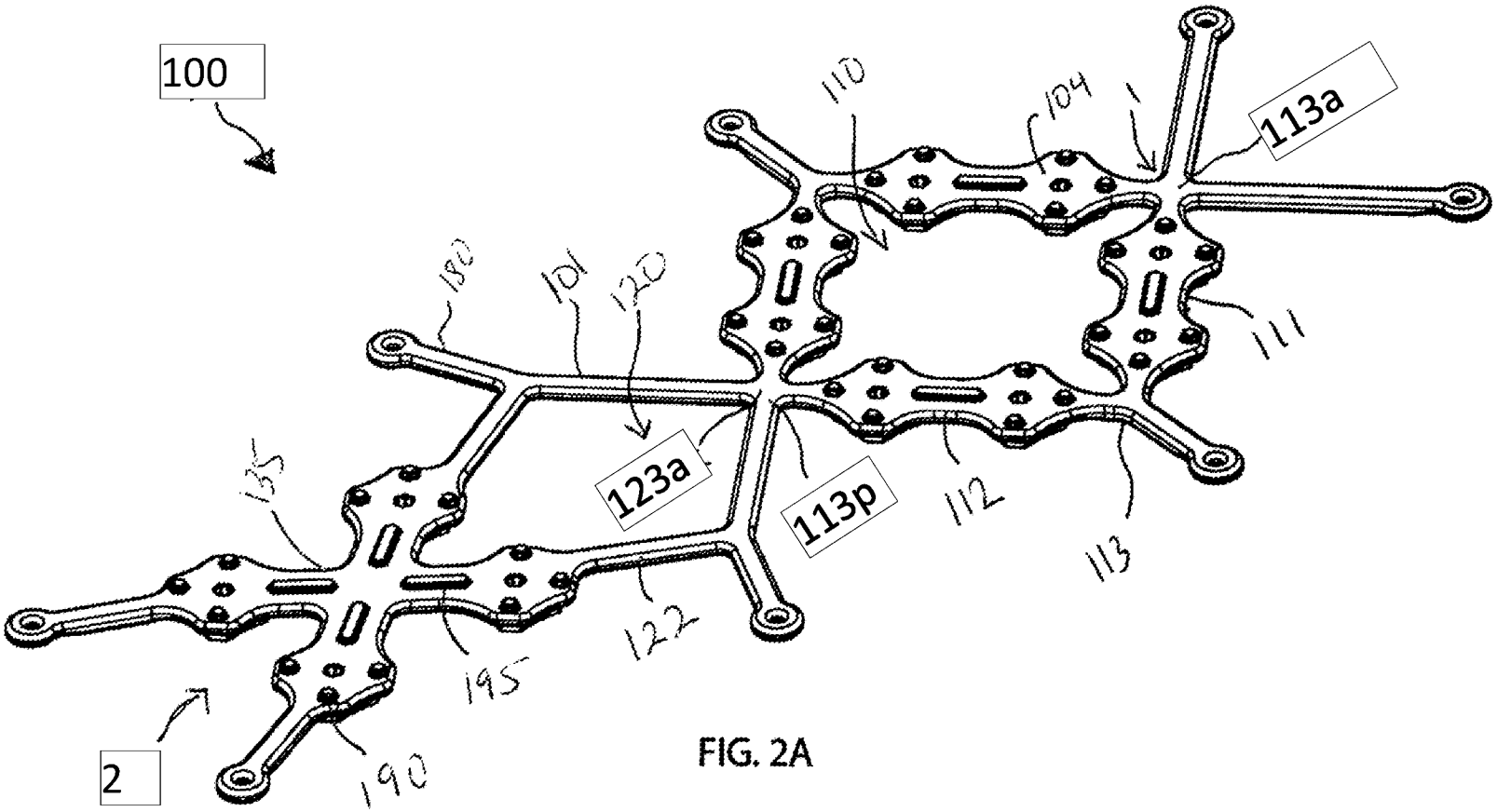
FIG. 2A to 2C illustrates an openwork traction base embodiment shown in FIGS. 1A to 1C. 2A illustrates a perspective view of the side of the base that would contact the underside of the footwear. 2B illustrates a perspective view of the side of the base that would engage with the terrain. 2C is a close up perspective view of a traction body shown in 2A.
Figure 2B:
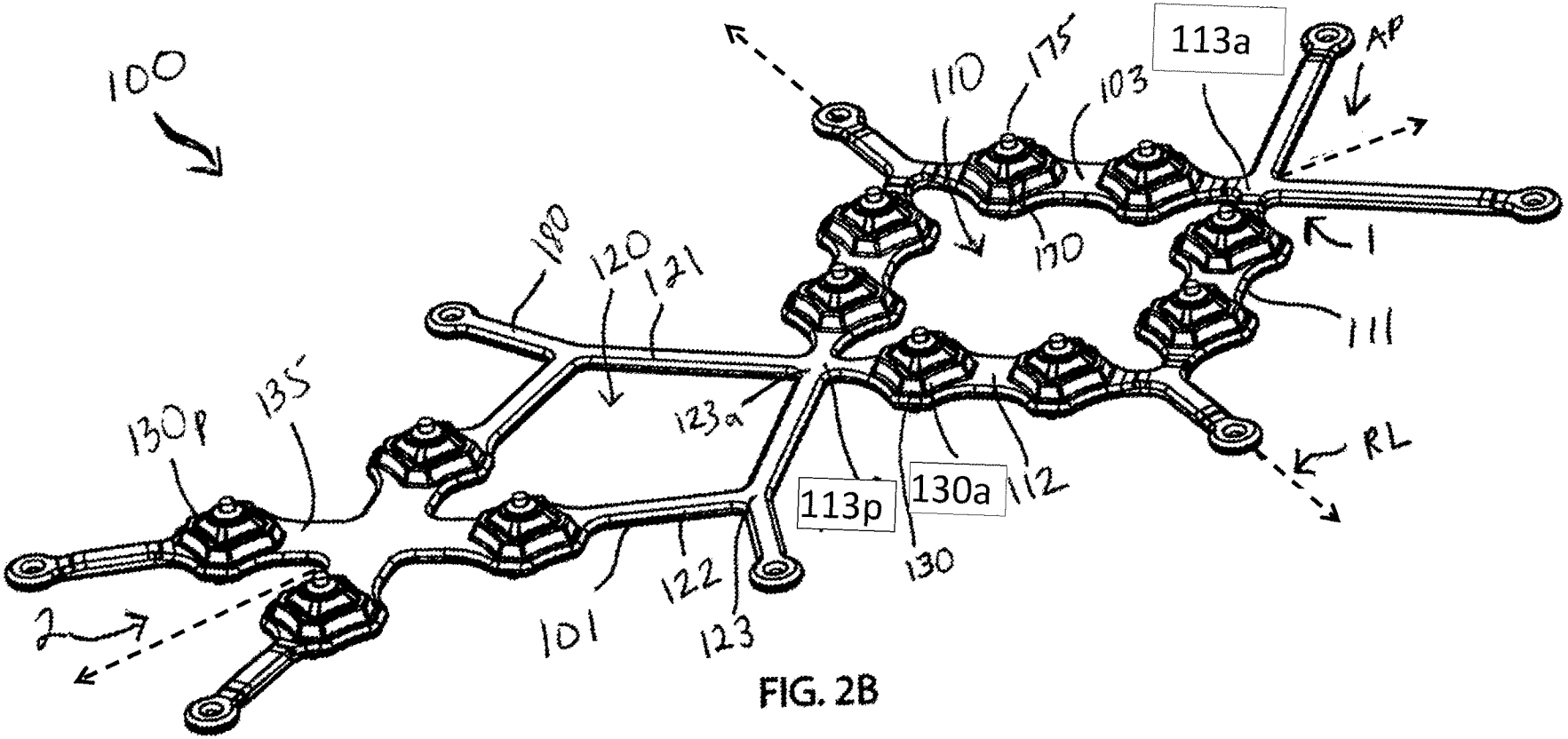

FIGS. 2A and 2B depict an embodiment of an openwork traction base 101. As can be readily appreciated by comparing the figures, the base 101 in FIGS. 2A and 2B illustrate an openwork traction base 101 not coupled to the elastomeric binding member 102 and is in a substantially planar orientation. FIG. 2A depicts the side that is intended to contact the underside of the footwear. FIG. 2B depicts the side that faces opposite the side depicted in FIG. 2A and that is intended to contact the ground when the user is, e.g., walking, running, or hiking.

In accordance with the present invention, the openwork traction base 101 defines a first opening 110 and a second opening 120. The first opening 110 is defined by a first polygonal form 111 that has at least four sides 112. The second opening 120 is defined by a second polygonal form 121 that has at least three sides 122. The polygonal forms 111 and 121 are relatively positioned so that the first opening 110 is nearer the anterior-end 1 than the posterior-end 2 and the second opening 120 is nearer the posterior-end 2 than the anterior-end 1. As such, the second opening 120 is predominantly below the midfoot and/or hindfoot during use, and the first opening 110 is predominantly below the forefoot during use. (The areas of the foot that form the hindfoot 3, midfoot 4, and forefoot 5 regions are depicted in FIG. 3.)

The openwork base 101 is configured so that the tread of the footwear is exposed and thus accessible to the terrain not only at the first and second openings 110, 120 but also in the region exterior to the polygonal forms. In some embodiments, the openwork base 101 is configured so that when a traction device 100 is disposed on footwear, at least 50% and up to 95% of the tread of the footwear is exposed (i.e., not covered by the openwork base). In some embodiments, the openwork base 101 is configured so that 65% to 85% or 65% to 75% or 75% to 85% of the tread of the footwear is exposed. In some embodiments, the openwork base 101 is configured so that 50% to 65% of the tread of the footwear is exposed.

A polygonal form (e.g., polygonal forms 111 and 121) comprises at least 3 sides that are angled relative to each other to define (enclose) an interior opening (e.g., opening 110 and 120). Each side meets and is coupled to an adjacent side at a vertex. The longitudinal axis of a side can be straight, but it can also be curved. A vertex is a region where two adjacent sides meet, and the interior facing surface (i.e., the surface of a polygonal form that defines the interior opening) at the vertex is angled or has a higher degree of curvature than the longitudinal axis of a side. In the embodiments shown, the polygonal forms have filleted corners. In addition, where the stirrups (described below) are coupled to a vertex, the corners can also be filleted.

Traction bodies 130 are coupled to and protruding from a surface 103 (shown in FIG. 2B) of the openwork traction base 101 that is opposite the surface 104 (shown in FIG. 2A) that faces the underside of the footwear 200 during use. Traction bodies 130 are configured to engage the ground to increase traction and improve stability when traversing a steep, uneven, icy, and/or snow-covered terrain. The openwork traction base 101 has coupled thereto, at the surface 103, a first plurality of traction bodies 130*a* that are located nearer the anterior end 1 than the posterior-end 2 of the device 100 and a second plurality of traction bodies 130*p* that are located nearer the posterior-end 2 than the anterior-end 1. The first plurality of traction bodies 130*a* are predominantly disposed underneath the forefoot when the device 100 is in use, i.e., disposed on footwear where the openwork traction base 101 extends on the undersole of the footwear. The second plurality of traction bodies 130*p* are predominantly disposed underneath the hindfoot or hindfoot and midfoot when the device 100 is in use.

First Polygonal Form

As mentioned above, the first polygonal form 111 can comprise at least four-sides 112, (such as 4, 5, 6, 7, 8, or more sides), and as such, at least four vertices 113. In the embodiment shown, the first polygonal form 111 has four sides 112, four vertices 113, and the sides are substantially the same length. In other embodiments, the first polygonal form 111 can be kite-shaped, such as the shape shown for the second polygonal form 120.

In embodiments, one, two, three, four, or more traction bodies 130*a* can be coupled to each of the four sides 112 of the first polygonal form 111. In embodiments with more than four sides 112, at least one side may not comprise any traction bodies 130*a* coupled thereto but at a minimum, four sides 112 will have traction bodies 130*a* coupled thereto. In the embodiment shown, the first polygonal form 111, as depicted in FIGS. 2A and 2B, has four sides 112 with 2 traction bodies 130 coupled to each side for a total of 8 traction bodies 130*a*.

In embodiments, the first polygonal form 111 is configured to have some elongatability which allows for a single size device 100 to accommodate multiple sizes of footwear. To facilitate, the first polygonal form 111 is oriented so that foremost vertex 113*a* and the hindmost vertex (the shared vertex) 113*p* of the first polygonal form are relatively positioned to each other such that the two vertices 113*a* and 113*p* intersect a single line (line AP) that generally extends between the forefoot and the hindfoot or that is substantially parallel to a longitudinal axis (line AP) of the traction device. Two vertices of the first polygonal form 110 not including the hindmost vertex (shared vertex) 113*p* of the first polygonal form are relatively positioned to each other such that the two vertices intersect a single line (line RL) that is substantially perpendicular to the single line (line AP) that generally extends between the forefoot and the hindfoot or a line that is substantially parallel to a longitudinal axis of the traction device.

Also facilitating the elongatability of the first polygonal form, the vertices of the first polygonal form are not particularly bulky as compared to the area of the openwork traction base supporting the traction bodies. Less bulk allows for the interior angle formed by the sides of the polygonal form meeting at a particular vertex to narrow or widen when tension is applied to the device along an anterior to posterior axis. Thus, in embodiments, no traction bodies 130*a* are located on the vertices 113*a* and 113*p*. And in a further embodiment, no traction bodies 130*a* are located on any of the vertices of the first polygonal form 111.

Filleted corners at the vertices can distribute the load and mitigate breakage at these regions. In embodiments, the first polygonal form 111 comprises filleted corners at one or more vertices 113 or at all vertices 113. Similarly, the corners where a stirrup 180 (discussed below) and a polygonal form meet, can be filleted corners as well.

Second Polygonal Form

As mentioned above, the second polygonal form 121 can comprise at least three sides 122, (such as 3, 4, 5, 6, 7, 8, or more sides), and as such, at least three vertices 123. In the embodiment shown, the second polygonal form 121 has four sides 122, four vertices 123, and the second polygonal form 120 is substantially kite-shaped. In other embodiments, the sides 122 of the second polygonal form 122 can be substantially the same length.

In embodiments, the first polygonal form 110 and the second polygonal form 120 share one or two vertices. In the embodiments shown, the hindmost vertex 113*p* of the first polygonal form 110 is the foremost vertex 123*a* of the second polygonal form 120.

Similarly facilitating the elongatability of the second polygonal form 120, one or more vertex 123 (e.g., foremost or lateral vertices 123) of the second polygonal form 120 are not particularly bulky or wide as compared to the area of the openwork traction base 101 supporting the traction bodies or between traction bodies 130. Again, less bulk allows for the interior angle formed by the sides of the polygonal form meeting at a particular vertex to narrow or widen when tension is applied to the device 100 along an anterior to posterior axis (e.g., along line AP). Thus, in embodiments, no traction bodies 130*p* are located on the vertices 123*a*. In further embodiments, no traction bodies 130*p* are located on the lateral vertices 123. And in even further embodiments, no traction bodies 130*p* are located on any vertex 123 of the second polygonal form 120. In some embodiments, three vertices 123 consisting of the shared vertex 113*p*, the foremost vertex 113*a*, and the hindmost vertex 123*p* are relatively positioned to each other such that the 3 vertices intersect a single line that is substantially parallel to a longitudinal axis (line AP) of the traction device 100.

In addition to the traction bodies 130*a* on the sides of the first polygonal form 111, the openwork traction base 101 comprises 2, 3, 4, 5, 6, or more traction bodies 130*p*. These additional traction bodies 130*p* are disposed predominantly below the hindfoot or midfoot and hindfoot during use. Stated another way, the traction bodies 130*p* are nearer the posterior-end 2 than the anterior-end 1.

In some embodiments, one or two or more of the at least three traction bodies 130*p* are located on a side of the second polygonal form 121. For example, in the embodiment shown, a traction body 130*p* is located on two of the four sides 122 of the four-sided second polygonal form 121. The two sides 122 of the second polygonal form 121 are those that are nearer the posterior-end 2 than the anterior-end 1 than the other two sides 122 of the second polygonal form 121. In the embodiment shown, four traction bodies 130*p* are coupled to an X-shaped form 135 and the four traction bodies 130*p* are substantially equidistant from the hindmost vertex 123*p*. As such, the traction bodies 130*p* are not coupled to the vertex 123.

Alternatively, other configurations of traction bodies 130*p* can be used. FIGS. 2D(i) to 2D(iii) are schematics of embodiments of an openwork traction base 101 with alternative configurations for the traction bodies 130*p*. For example, one of at least three traction bodies 130*p* can be located on a vertex of the second polygonal form 121, as illustrated in FIG. 2D(i). In FIG. 2D(i), three traction bodies 130*p* are coupled to a triangular form 140. The triangular form 140 shares a vertex 123, specifically vertex 123*p*, with the second polygonal form 121, and a traction body 130*p* is coupled to the triangular form 140 at each of its vertices 143. As such, one traction body is coupled to the vertex 123*p* of the second polygonal form 121. In some embodiments, the triangular form 140 defines an opening and in others, the triangular form 140 is a triangular plate.

In other embodiments, no traction bodies 130*p* are located on a side 122 or vertex 123 of the second polygonal form 121. For examples, as illustrated in FIGS. 2D(ii) and (iii), four traction bodies are coupled to a circular form 150 and four-sided 160, respectively, where a portion of the form 150/160 intersects with the vertex 123*p* of second polygonal form 121. No traction bodies 130*b* are located at this area of intersection with vertex 123*p*. The traction bodies 130*p* of the four-sided form 160 are located on the vertices 164 of the form. The traction bodies 130*p* of the circular form 150 are evenly spaced along the circular form 150. In some embodiments, the four-sided form 160 or the circular form 150 defines an opening and in others, the four-sided form 160 or the circular form 150 is a four-sided plate or circular plate, respectively.

Traction Bodies

As noted above, a traction body 130 is a protrusion on the surface of the openwork traction base that engage with terrain to improve traction and stability. A close up view of a traction body 130 is depicted in FIG. 2B is provided in FIG. 2C.

Figure 2C:
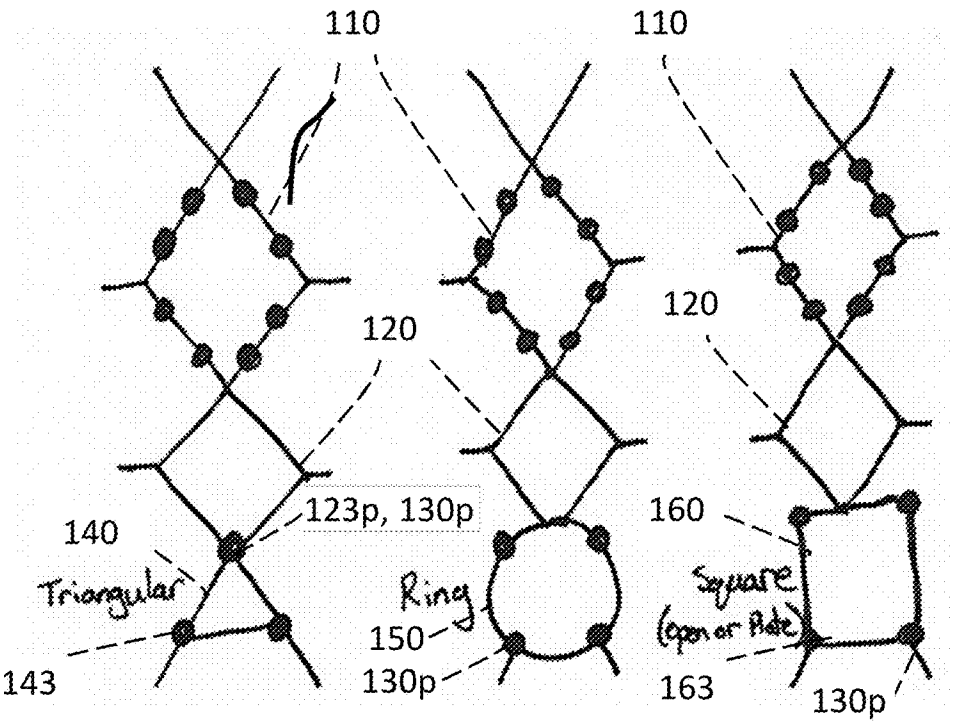
Figure 2C:
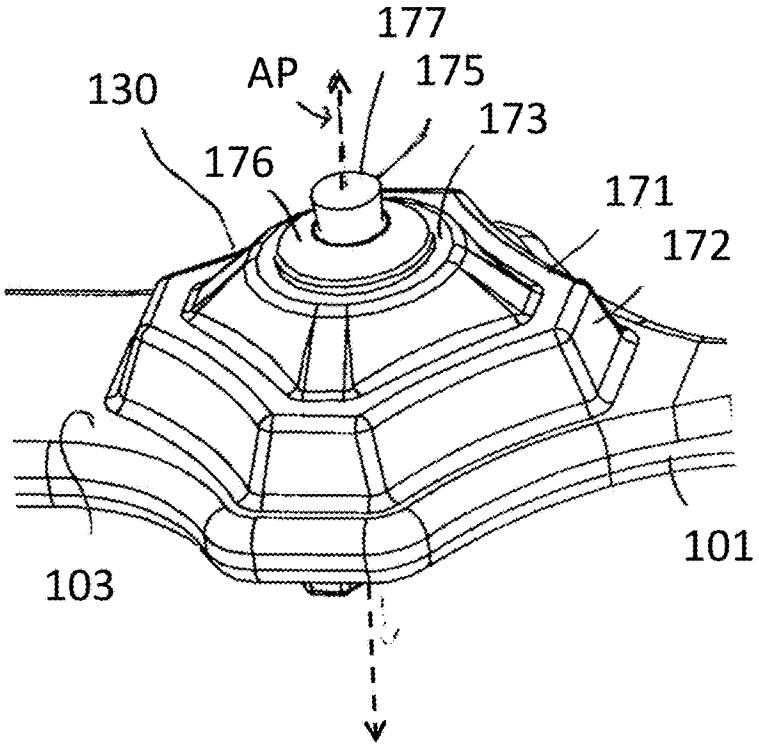

With reference to FIG. 2C, each of the traction bodies 130 comprise a cleat 170 and a spike 175 coupled to the cleat. The cleat 170 is coupled to and protruding from a surface 103 of the openwork traction base 101 that is opposite the surface that faces the underside of the footwear during use. In embodiments, the openwork traction base 101 and the cleat 170 can be integrally formed. The cleat 170 is polymeric.

As for the shape of the cleat 170, it is such to enhance traction. The cleat 170 can comprise a stepped or sloping surface or otherwise comprises surface protrusion or edges configured to engage terrain during use. As shown, the cleat can comprise a frusto-pyramid-like shape. In some embodiments, such as the one illustrated herein, the cleat can comprise a cross-sectional shape, extending in a plane that is parallel to the longitudinal axis (line AP) that has concave sides 171 and chamfered corners 172.

As for the height of a cleat 170, as measured from the surface 103 of the openwork base 101 to the distal end 173 of the cleat, it can have a height between 3 mm to 10 mm. The height can be more or less depending on the thickness of the openwork base 101 and the height of the portion of the spike 175 that is exposed (i.e., the portion not embedded in the cleat). In some embodiments, the height of the polymeric cleat 170 can be 5 mm to 7 mm. In embodiments, the effective height (the distance from surface 104 to the tip of the spike) of a traction body 130 is between 8 mm and 16 mm. In embodiments, the effective height is between 10 mm to 13 mm, optionally wherein the polymeric cleat is between 5 mm and 7 mm.

Contributing to the effective height of the traction body and to further improve the ability of a traction body 130 to engage with the terrain, the free-edge portions of the openwork traction base 101 to which the traction body 130 is coupled is wider than the base of the traction body 130, but only by 0.5 mm to 2.5 mm on each side 171 and on two of the corners 172 of the traction body 130 or on all of the corners 172 and two of the sides 171. Or in some embodiments, wider on each side 171 and two of the corners 172 by 8-15% of the widest portion of the traction body 130 or wider by 8-15% of the widest portion of the traction body 130 on all of the corners 172 and two of the sides 171. In embodiments, the width of a portion of the openwork traction base to which the traction body is coupled is between 0.75 in-1.10 in.

The spike 175 comprises an anchoring base 176 (partially shown) and a traction tip 177, wherein the anchoring base is wider than the traction tip 177 and the anchoring base 176 is held by the cleat 170. The spike 175 can be composed of a metal and/or carbide. In some embodiments, the anchoring base is a metal, such as aluminum, and the traction tip 177 is carbide. In some embodiments, the traction tip 177 on the spike 175 has a concave or sunken surface such as that shown in FIG. 5. Specifically, the concave or sunken surface is such that the outer perimeter of the traction tip 177 is the initial surface of the spike 175 to touch the ground before a portion of the surface more interior to the perimeter (such as the centermost point) touches the ground. This structure has the advantages of increasing the initial pressure into the ground and forcing an edge to catch the surface immediately, thereby minimizing slippage of the spike (and nearly eliminating it altogether).

With reference to FIG. 2B, the surface 104 of the openwork traction base 101 facing the underside of the footwear during use can comprise a plurality of protrusions 190, 195. In the embodiment shown, the protrusions 190, which can be small knobs or bumps, are positioned to in the vicinity—on the opposite side of—a traction body 130. In the embodiment shown, the protrusions 195, which are longer than the protrusions 190, are positioned on the portion of the openwork traction base 101 between two traction bodies 130. These protrusions can be integrally formed with the openwork traction base 101. However, these protrusions 190/195 are do not contribute to the thickness values or relative thickness described herein. In embodiments, the height of the protrusions 190/195 from the surface is less than or equal to the thickness of the openwork traction base 101. In embodiments, the height of the protrusions 190/195 can be within a range that allows for better surface area contact with the underside of the footwear while allowing for some engagement with the grooves in the sole of the shoe. In some embodiments, the protrusions 190/195 is between 0.02 inches to 0.06 inches or between 0.02 inches to 0.05 inches or between 0.02 inches to 0.04 inches. In some embodiments, the height of longer protrusions 195 can be no more than 0.05 inches or no more than 0.04 inches, and the height of shorter protrusions 190 can be no more than 0.04 inches or no more than 0.03 inches.

In terms of the thickness of the openwork traction base 101, for the purpose of durability, a foremost vertex 113*a* of the first polygonal form 111 has a thickness greater than the shared vertex 113*p* or the remainder of the openwork traction base. The thickness of the openwork traction base can be between 0.1 in-0.2 in.

As for the width of the various sections of the openwork traction base 101, it is widest about the traction bodies, as discussed above. Moreover, the portion of the openwork traction base 101 to which a traction body 130 is coupled can be wider than the portion of the openwork traction base 101 between two adjacent traction bodies 130 coupled to a single side 113. In embodiments, the width of a portion of the openwork traction base between traction bodies is between 0.40 in-0.60 in. In some embodiments, within the first polygonal form 111, the portion of the openwork traction base 101 between two adjacent traction bodies 130 coupled to a single side 112 is wider than the portion of the openwork traction base between a vertex 113 and a traction body 130. The portion of the openwork traction base 101 interconnecting the at least three traction bodies 130*p* in the hindfoot is wider than the portion of the openwork traction base 101 between a vertex 113 of the first polygonal form 110 and a traction body 130. In embodiments, the narrowest width of a section of the openwork traction base is 0.200 in-0.300 in, such as between a traction body 130*a* and a vertex 113 or between the foremost vertex 123*p* and the X-shaped form 135.

In embodiments, the openwork traction base 101 consists of a homogenous polymeric material, which can be a thermoplastic polyurethane. The polymeric material has a hardness of Shore 80A to Shore 98A. The openwork traction base 101 can be formed by injection molding of the polymeric material. As in the embodiment shown, the openwork traction base 101, the traction bodies 130, and the stirrups are integrally formed by injection molding of the polymeric material.

Stirrups

The footwear traction device comprises a footwear binding member 102 configured to secure the openwork traction base 101 to the underside of the footwear. The footwear binding member 102 is coupled to the openwork traction base 101 at 6 or more sites, such as 6, 7, or 8 sites. Stirrup 180 has a length sufficient to couple the elastic band 102 to the openwork traction base 101, whether directly or through a intervening component, such as a coupling ring. Stirrup 180 can be a chain, bar, or a narrow strip of material. As in the embodiment shown, stirrup 180 can be integrally formed with the openwork traction base 101. A stirrup 180 can be coupled to each vertex 113 of the first polygonal form 110 except for the hindmost vertex 113*p* (or shared vertex) of the first polygonal form 111. A stirrup 180 can also be coupled to each of two vertices 123 of the second polygonal form 120, which are not the hindmost vertex 113*p* of the first polygon form (or shared vertex) or a hindmost vertex 123*p* of the second polygonal form 120. In addition, in some embodiments, one, two, or more stirrups 180 can be coupled to the form to which the hindfoot traction bodies 130*p* are coupled. A stirrup 180 can be coupled to the form at a location on the form that is nearer a traction body 130*p* than a vertex As for the width and thickness of a stirrup 180, each stirrup 180 has a width that is substantially the same as at least one side of the second polygonal form. In embodiments, the width of a stirrup is between 0.15 in-0.30 in.

In embodiments, the thickness of a stirrup can be 0.1 to 0.2 in or 0.1 to 0.15 in. In some embodiments, the thickness of a stirrup 180 located on the lateral side of the device 100 can be less than the stirrups 180 located on an anterior-end 1 and/or a posterior end 2. For example, the thickness of a stirrup 180 located on the lateral side and coupled to the second polygonal form can be thinner than the remaining stirrups. In embodiments, the thickness of a stirrup 180 at an anterior-end 1 or a posterior end 2 can be 10% to 60% thicker than the lateral stirrups.

Footwear Binding Member

The footwear binding member 102 can be elastic band or a system of straps and fasteners that allow for secure fit of the device 100 to an item of footwear. The elastic band is made of a material that is more elastic and has a lower hardness than the openwork traction base.

Devices described and illustrated herein can be used on both paved surfaces and trail, including trails with steep rocky inclines.

The invention claimed is:

1. A footwear traction device configured to be disposed about footwear comprising an openwork traction base defining a first opening and a second opening, the first opening defined by a first polygonal form having at least four sides with each side having 1 to 4 traction bodies coupled thereto and relatively positioned such that the first opening is predominantly below a forefoot during use;

the second opening defined by a second polygonal form having at least three sides and relatively positioned such that the second opening is predominantly below a midfoot and/or a hindfoot during use, the openwork traction base comprises at least three traction bodies and configured such that the at least three traction bodies are relatively positioned such that at least one of the at least three traction bodies is disposed predominantly below the hindfoot during use, wherein the openwork traction base consists of a homogenous polymeric material.

2. The footwear traction device of claim 1, wherein a traction body is not located on any vertex of the first polygonal form.

3. The footwear traction device of claim 1, wherein each of the traction bodies comprise a cleat, wherein a spike is coupled to the cleat.

4. The footwear traction device of claim 3, wherein the openwork traction base and the at least three traction bodies are integrally formed.

5. The footwear traction device of claim 4, wherein the cleat is coupled to and protruding from a surface of the openwork traction base that is opposite the surface that faces the underside of the footwear during use.

6. The footwear traction device of claim 5, wherein the cleat comprises a stepped or sloping surface or otherwise comprises surface protrusion or edges configured to engage terrain during use.

7. The footwear traction device of claim 6, wherein the spike comprises an anchoring base and a traction tip, wherein the anchoring base is wider than the traction tip and the anchoring base is held by the cleat.

8. The footwear traction device of claim 7, wherein the traction bodies comprise a spike that has a traction tip, wherein the traction tip comprises a sunken or concave surface.

9. The footwear device of claim 6, wherein the cleat comprises a cross-sectional shape that has four concave sides and chamfered corners.

10. The footwear device of claim 6, wherein each of the sections of openwork traction base supporting each of the traction bodies is wider than the traction body which it supports.

11. The footwear traction device of claim 1, wherein the first polygonal form defining a first opening and the second polygonal form defining a second opening share one vertex.

12. The footwear traction device of claim 11, wherein 3 vertices including the shared vertex are relatively positioned to each other such that the 3 vertices intersect a single line that is substantially parallel to a longitudinal axis of the traction device.

13. The footwear traction device of claim 1, wherein the first polygonal form is four-sided or wherein the second polygonal form is four-sided.

14. The footwear traction device of claim 1, wherein on the first polygonal form, the portion of the openwork traction base between two adjacent traction bodies coupled to a single side is wider than the portion of the openwork traction base between a vertex and a traction body.

15. The footwear traction device of claim 1, wherein the portion of the openwork traction base to which the traction body is coupled is wider than the base of the traction body.

16. The footwear traction device of claim 15, wherein the width of a portion of the openwork traction base between traction bodies coupled to a single side is between 0.400 in-0.600 in and wherein the width of a portion of the openwork traction base to which the traction body is coupled is between 0.750 in-1.050 in.

17. The footwear traction device of claim 1, wherein the openwork traction base comprises an X-shaped, four-sided, three-sided, or circular form positioned such that the X-shaped, four-sided, three-sided, or circular form is predominantly below the hindfoot during use wherein the at least three traction bodies are coupled thereto and wherein the second opening is between the X-shaped, four-sided, three-sided, or circular form and the first opening.

18. The footwear traction device of claim 1, wherein the openwork traction base comprises a stirrup coupled to each vertex of the first polygonal form of the first polygonal form and to each of two vertices of the second polygonal form, wherein a stirrup is not coupled to the hindmost vertex of the first polygon form or a hindmost vertex of the second polygonal form.

19. The footwear traction device of claim 18, wherein the openwork traction base comprises a stirrup coupled to each of two of the at least three traction bodies and wherein each stirrup is coupled to a footwear binding member.

20. A footwear traction device configured to be disposed about footwear comprising an openwork traction base defining a first opening and a second opening, the first opening defined by a first polygonal form having at least four sides with each side having 1 to 4 traction bodies coupled thereto and relatively positioned such that the first opening is predominantly below a forefoot during use;

the second opening defined by a second polygonal form having at least three sides and relatively positioned such that the second opening is predominantly below a midfoot and/or a hindfoot during use, the openwork traction base comprises at least three traction bodies and configured such that the at least three traction bodies are relatively positioned such that at least one of the at least three traction bodies are is disposed predominantly below the hindfoot during use, wherein the openwork traction base and the at least three traction bodies are an integrally formed polymeric component.

* * * * *